US005628650A

United States Patent [19]

Jackson et al.

[11] Patent Number: 5,628,650

[45] Date of Patent: May 13, 1997

[54] TERMINATION UNIT FOR TELECOMMUNICATION AND DATA LINES

[75] Inventors: Simon Jackson; Christopher Taylor, both of Cheltenham, England

[73] Assignee: Krone AG, Berlin-Zehlendorf, Germany

[21] Appl. No.: 351,829

[22] Filed: Dec. 8, 1994

[30] Foreign Application Priority Data

Dec. 9, 1993 [DE] Germany ..... 43 42 517.8

[51] Int. Cl.[6] ..... H01R 13/74

[52] U.S. Cl. ..... 439/536; 439/131; 361/119

[58] Field of Search ..... 439/534–537, 439/540.1, 131; 361/56, 111, 112, 117–119

[56] References Cited

U.S. PATENT DOCUMENTS

| | | | |
|---|---|---|---|
| 4,460,233 | 7/1984 | Newton et al. | 439/535 |
| 4,477,141 | 10/1984 | Hardesty | 439/535 |
| 4,717,358 | 1/1988 | Chaundy | 439/557 |
| 4,894,024 | 1/1990 | Debortoli et al. | 439/535 |
| 5,074,804 | 12/1991 | Pantland et al. . | |
| 5,122,069 | 6/1992 | Brownlie et al. | 439/535 |
| 5,356,310 | 10/1994 | Garthwaite et al. | 439/535 |
| 5,356,311 | 10/1994 | Liu | 439/540.1 |
| 5,362,254 | 11/1994 | Siemon et al. | 439/536 |
| 5,397,929 | 3/1995 | Hogarth et al. | 439/535 |
| 5,458,503 | 10/1995 | Below | 439/536 |

FOREIGN PATENT DOCUMENTS

| | | |
|---|---|---|
| 0024022A1 | 7/1980 | European Pat. Off. . |
| 0445376A1 | 3/1990 | European Pat. Off. . |
| 3833032A1 | 5/1990 | Germany . |

*Primary Examiner*—Gary F. Paumen
*Attorney, Agent, or Firm*—McGlew & Tuttle

[57] ABSTRACT

A termination unit for telecommunication and data lines, including a front portion provided with an insertion opening, a frame, an electrical plug connector, a plug socket and contact elements for the lines. In order to simplify accessibility to the electrical plug connector of the termination unit, the front portion is adapted as one piece together with the frame and is provided with a removable access cover and that the electrical plug connector and the plug socket are disposed on the rear side of the removable access cover behind the insertion opening of a component unit disposed on the rear side of the front portion and connected to the plug connector with the plug socket.

13 Claims, 12 Drawing Sheets

TERMINATION UNIT FOR TELECOMMUNICATION AND DATA LINES

FIELD OF THE INVENTION

The present invention relates to a termination unit for telecommunication and data lines including a front portion provided with an insertion opening, a frame, an electrical plug connector, a plug socket and clamping contact elements for connection to lines.

BACKGROUND OF THE INVENTION

A termination unit of the type referred to hereinbefore is known in the art from DE 38 33 032 A1.

The termination unit disclosed in DE3833032A1 comprises electrical plug connectors disposed in a frame mounted on a housing wall, in order to permit a connection between telephone or telecommunication installations and the electrical wiring, the components or circuit arrangements are provided behind the front portion. The electrical plug connectors inserted in the frame comprise electrical components or circuits, e.g. printed circuit boards, that are required to permit an interface between, e.g., a telephone hand set and the telephone wiring connected to the circuits. The telephone hand set is connected to the termination unit by a plug connector, the plug of which is inserted into a plug socket provided in the front panel. The prior art embodiments are complicated to install and difficult to repair, if a fault occurs. The prior art embodiments also require a large volume.

SUMMARY AND OBJECTS OF THE INVENTION

It is therefore the object of the invention to simplify accessibility to the electrical plug connector of the termination unit of the type referred to hereinbefore.

According to the invention, a termination unit for telecommunication and data lines is provided including a front portion provided with an insertion opening. The front portion is adapted as one piece together with a frame and is provided with a removable access cover. An electrical plug connector, a plug socket and clamping contact elements for the lines are also provided. The electrical plug connector and the plug socket are disposed on a rear side of the removable access cover, behind the insertion opening of a component unit, disposed on a rear side of the front portion and connected to the plug connector with a plug socket. By the features according to the invention, accessibility to the plug connector mounted behind the insertion opening of the front portion as well as to the component unit optionally disposed in the frame is substantially facilitated, when the access cover or the front portion, resp., is removed.

In a preferred manner, the plug connector is adapted as one piece together with the clamping contact elements and is disposed on the rear side of the access cover. With this structure, the clamping contact elements are easily accessible for terminating lines, e.g. for telephone extensions, by opening the access cover. In the particularly preferred embodiment, the frame has on its front side a forwardly open reception portion for inserting the open access cover, pivoted forwardly by approx. 120°. Hereby, the removed access cover is held in an inclined plane, so that the operator has both hands free for terminating the lines at the clamping contact elements of the plug connector.

In another preferred embodiment, the contact elements of the plug connector are adapted in the form of insulation displacement contact elements extending with their contacts into the plug socket. In the plug connector, additional clamping contacts are disposed in a chamber so to establish a simple, loosenable electrical connection between the component unit and the plug connector with the plug socket.

In another preferred embodiment, disconnect contact elements are provided in the additional chamber, instead of the clamping contacts, in order to permit measurement or test actions or to separate the connection by insertion of a test plug.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
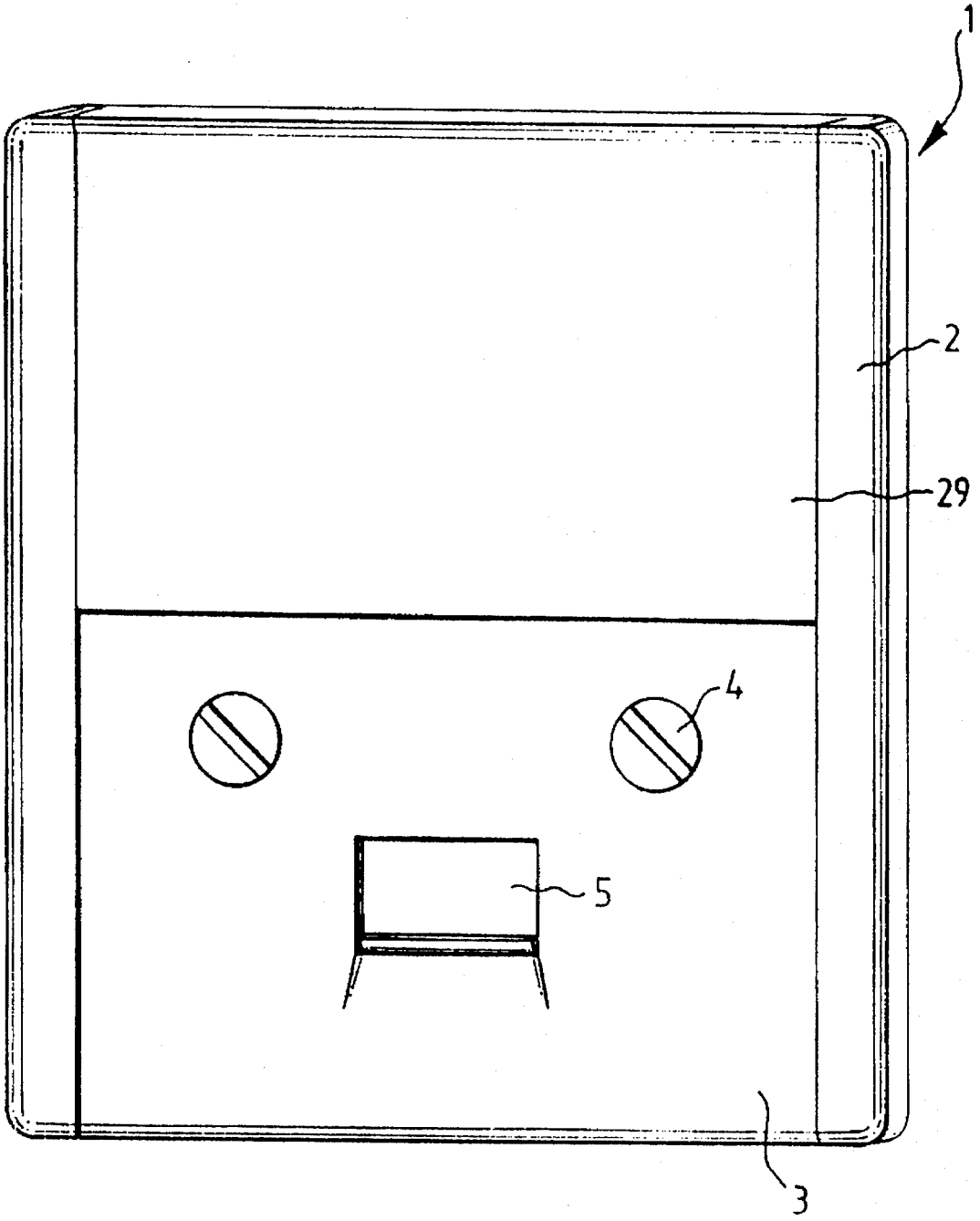
FIG. 1 is a front view of the of the termination unit.

FIGS. 1 to 5 show the first embodiment of the termination unit comprising a frame 1 formed of moulded plastic with a front panel portion 2 and a removable access cover 3 attached at the front portion 2 by means of screws 4 and having an insertion opening 5 permitting access to a plug connector 12 having a plug socket 6 for receiving a not shown telephone jack plug. The front portion 2 can be mounted, together with its frame 1, in a conventional housing or it can be flush with a housing wall.

Figure 3:
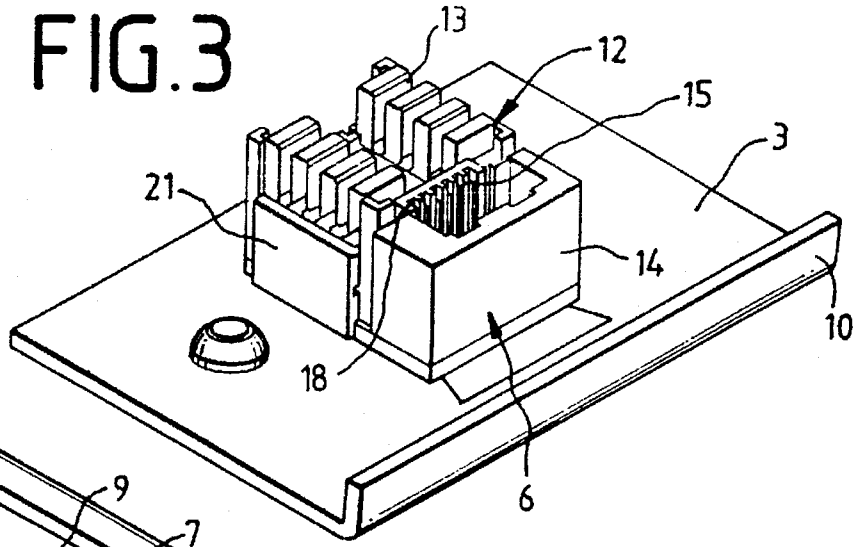
FIG. 3 is a perspective rear view of the access cover.
Figure 2:
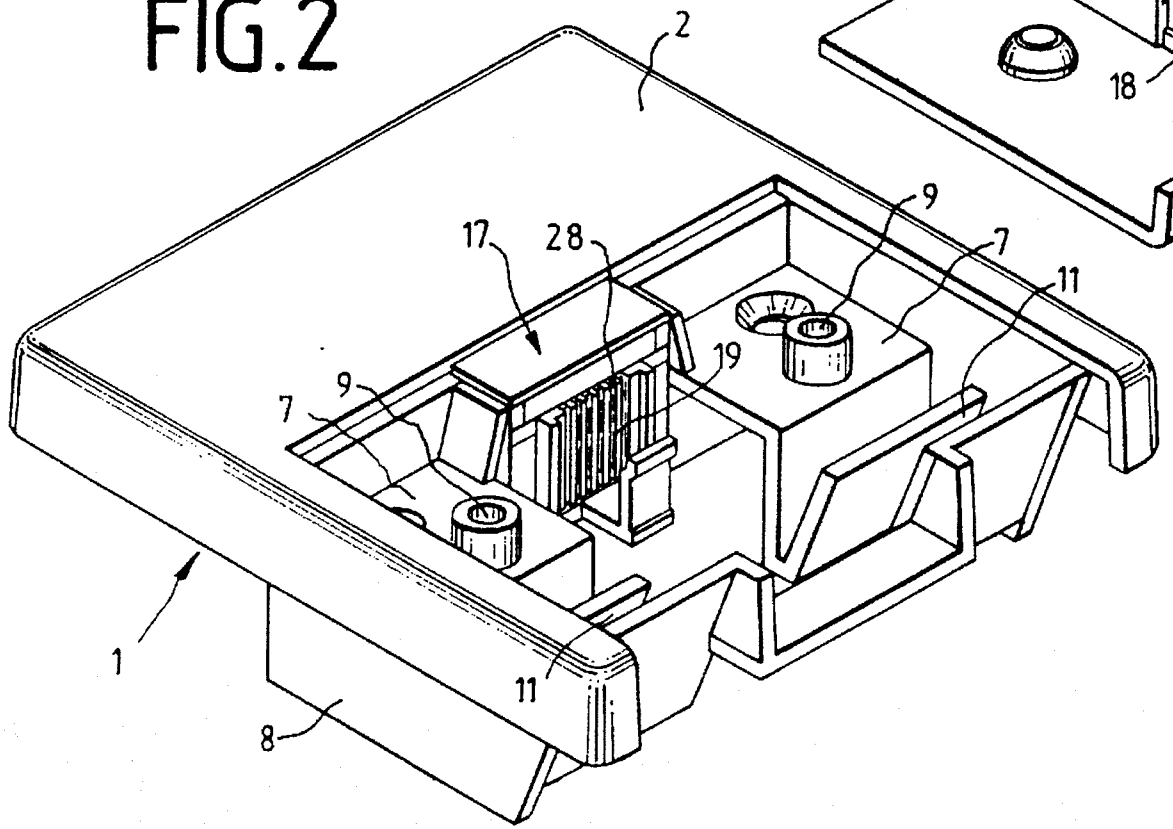
FIG. 2 is a perspective view of the termination unit of FIG. 1 with access cover removed.

FIG. 2 shows the front portion 2 with removed access cover 3, being shown in rotated condition in FIG. 3, so that its rear side is visible. Behind the removed access cover 3, the front portion 2 comprises two lateral spaced console portions 7, each of which has an upwardly extending threaded projection 9 provided with an internal thread, so that the screws 4 can be screwed into the threaded projections 9 for attachment of the access cover 3. At one end, each console portion 7 has a moulded receiving portion 11 directed towards the bottom side of the front portion 2, the purpose of which will be described further below. On the rear side, the frame 1 of the front portion 2 comprises box-type frame portions 8. These frame portions are moulded from plastic as one piece, together with the frame 1.

FIG. 3 shows that the plug connector 12 is disposed on the rear side of the access cover 3 provided with a border strip 10, the cover being removable even by a telephone subscriber. The plug connector 12 is composed of a moulded plastic housing 21 provided with contact slots 13 wherein insulation displacement contact elements (IDC contacts) are arranged, as is described in more detail in the EP 0 445 376 A1 (see also U.S. Pat. No. 5,074,804 which is hereby incorporated by reference). The plug connector 12 further comprises a guide frame 14 having a multitude of elongated metal contacts 15. The contacts 15 are disposed in grooves 18 which are formed in the guide frame 14 of the plug connector 12. The contacts 15 extend from one side of the plug socket 6 receiving the not shown telephone jack plug, to the opposite side of the plug connector 12, so that these can contact other components which will be described below.

Figure 4:
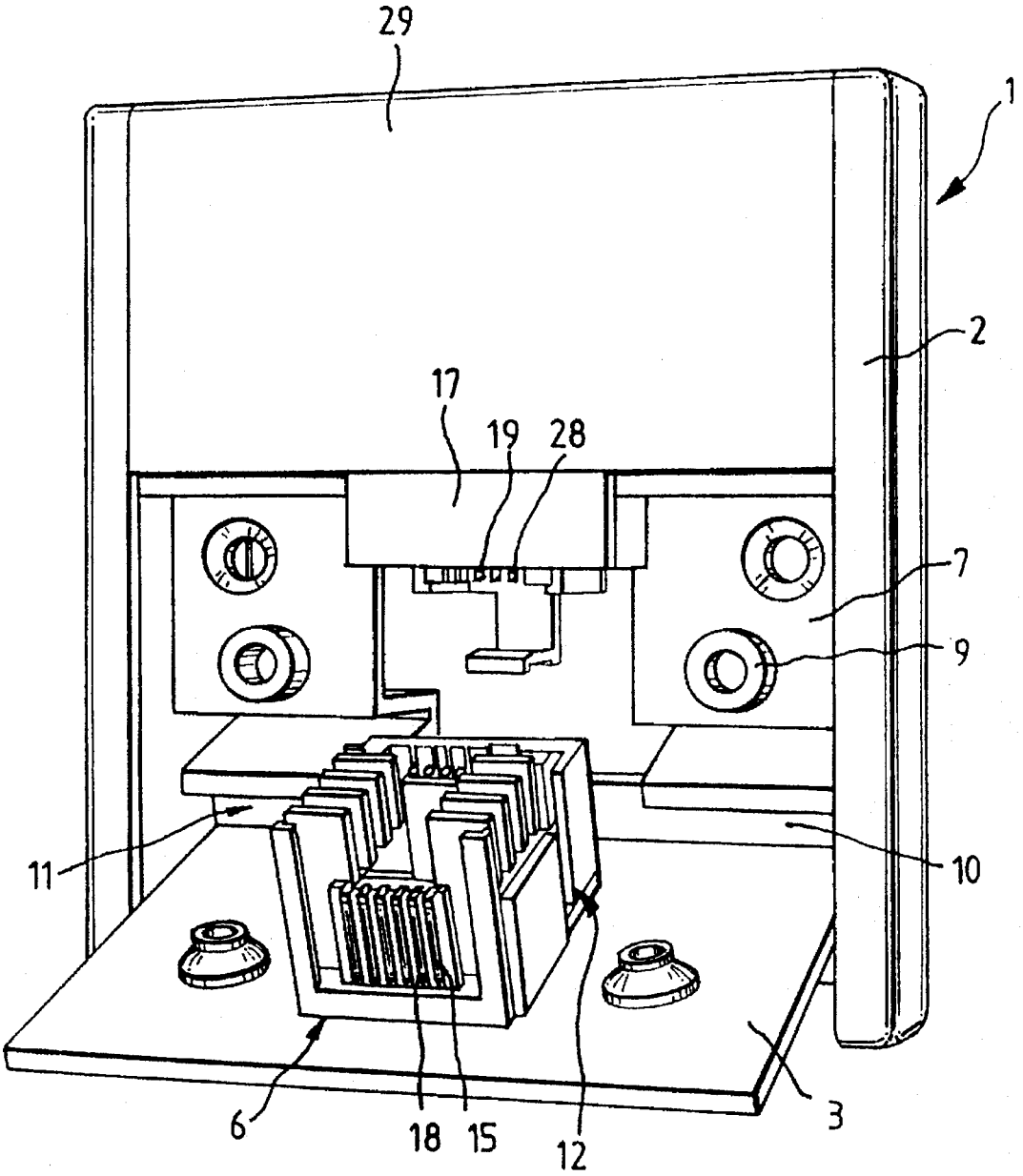
FIG. 4 is a perspective top view of the termination unit with removed cover inserted for line connection.
Figure 5:
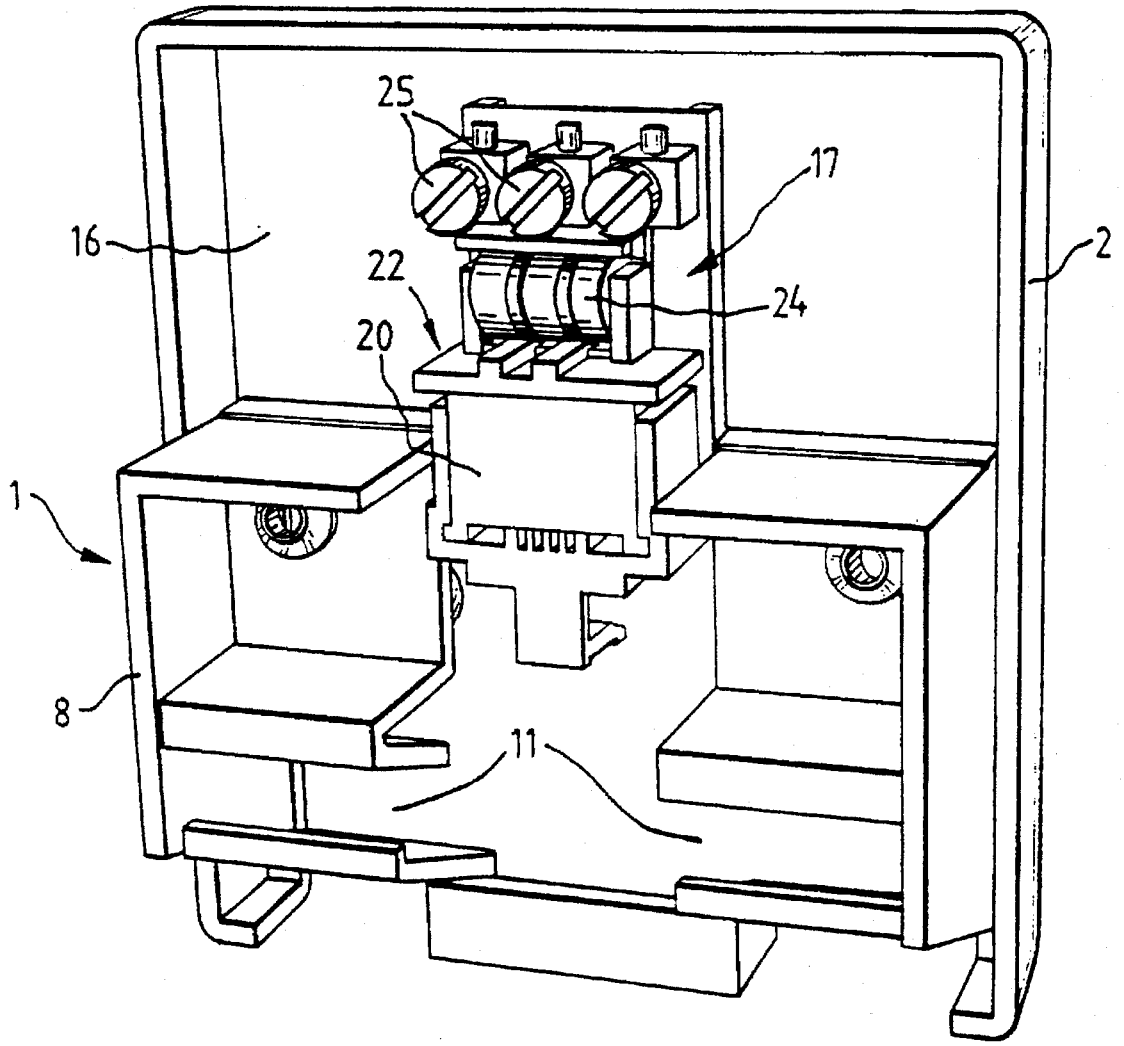
FIG. 5 is a rear view of the front portion with assembled component unit.
Figure 7:
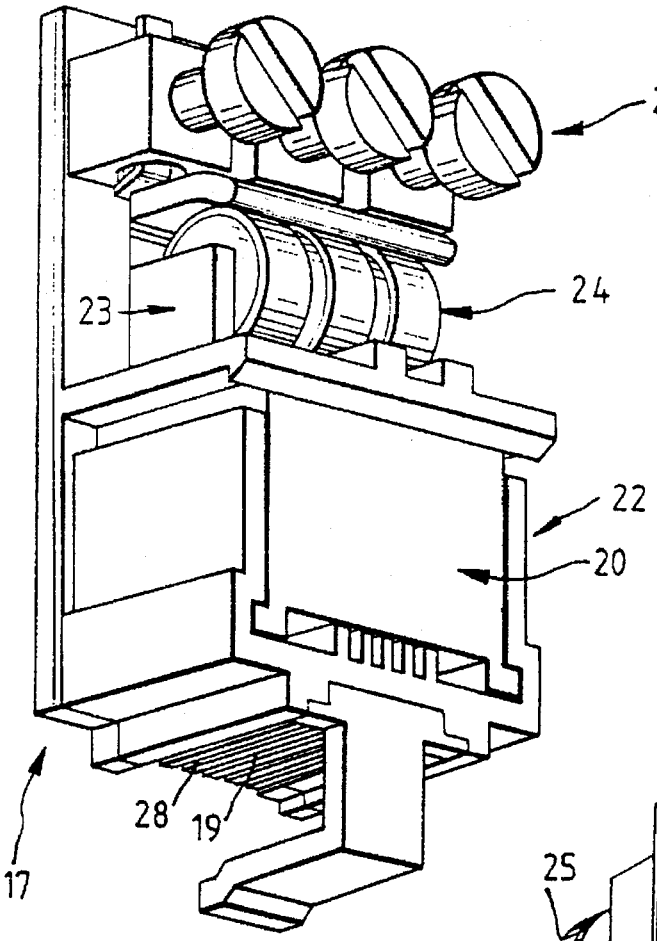
FIG. 7 is a perspective rear view of the component unit of the electrical plug connector.
Figure 8:
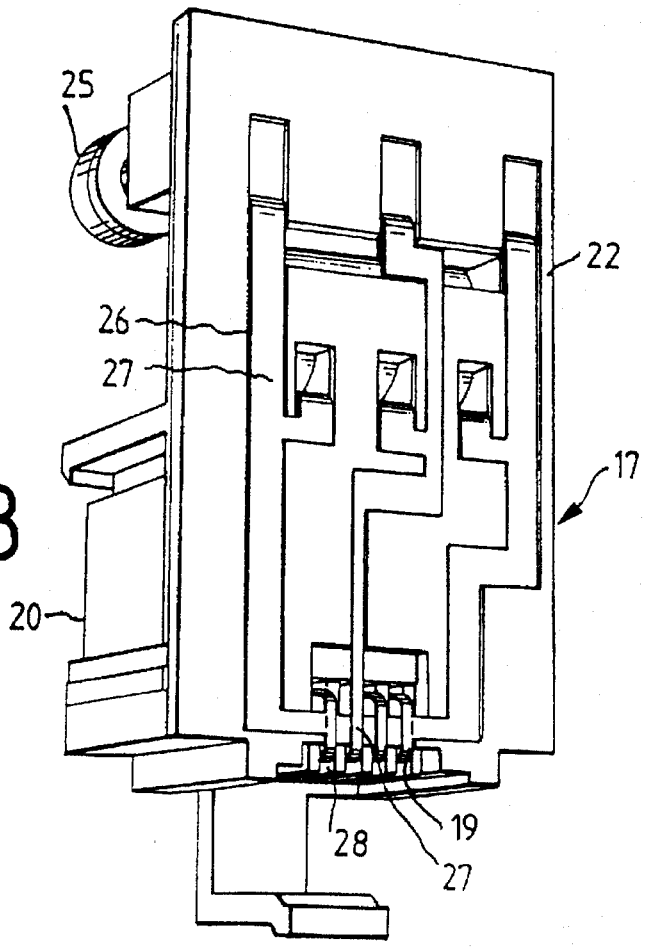
FIG. 8 is a perspective front view of the component unit.

FIGS. 2, 4 and 5 show that the upper portion 16 of the front portion 2 carries a component unit 17 on its rear side, which is shown in more detail in FIGS. 7 and 8, and which is formed of a moulded plastic housing 22 and comprises connection means with grooves 28 in the lower section for receiving contact fingers 19. The contact fingers 19 are movable into contact connection with the corresponding connection means of contacts 15 in the grooves 18 of the guide frame 14 of the plug connector 12 as shown in FIG. 4. The moulded plastic housing 22 is further provided with a chamber 20 for receiving additional electrical components, in particular a capacitor and resistor unit. Above the capacitor and resistor unit, the moulded plastic housing 22 has a free space 23 for a gas-discharge tube 24, and above thereof are disposed connection elements 25 for connection with the ends of the communication wiring, said elements being screw connections or IDC contacts.

FIG. 8 shows that the leads 27 of the contact fingers 19 of the component unit 17 extend from the lower portion upwards within moulded channels 26 and terminate in the connection elements 25. As intermediate positions, leads of the contact fingers 19 branch away, these leads being in contact with the capacitor and resistor unit disposed in the chamber 20 and with the gas-discharge tube 24.

The rear side of the front portion 2 is moulded as a frame portion 8 and forms connection portions connecting correspondingly shaped parts of the housing 22 of the component unit 17. The component unit 17 comprising a snap connection with the rear side of the front portion 2. The plug connector 12 is attached on the rear side of the access cover 3 for the subscribers. This kind of arrangement is a particularly effective modular arrangement and design, which can extremely easily be assembled as well as disassembled, for instance in case of a fault. Further, the removable access cover 3, accessible for the subscriber, can be positioned at the front portion 2 in the manner shown in FIG. 4. The access cover 3 is arranged such that it is held in the lower section of the front portion 2 in the moulded receiving portion 11, the border strip 10 guided into the receiving portion 11 being clamped between the wall portions limiting at the top and bottom the receiving portion 11. The access cover 3 is received in an arrangement where the subscriber needs not manually hold the access cover 3 and has both hands free to connect the wiring to the insulation displacement contact elements (IDC contacts) of the plug connector 12.

Figure 6:
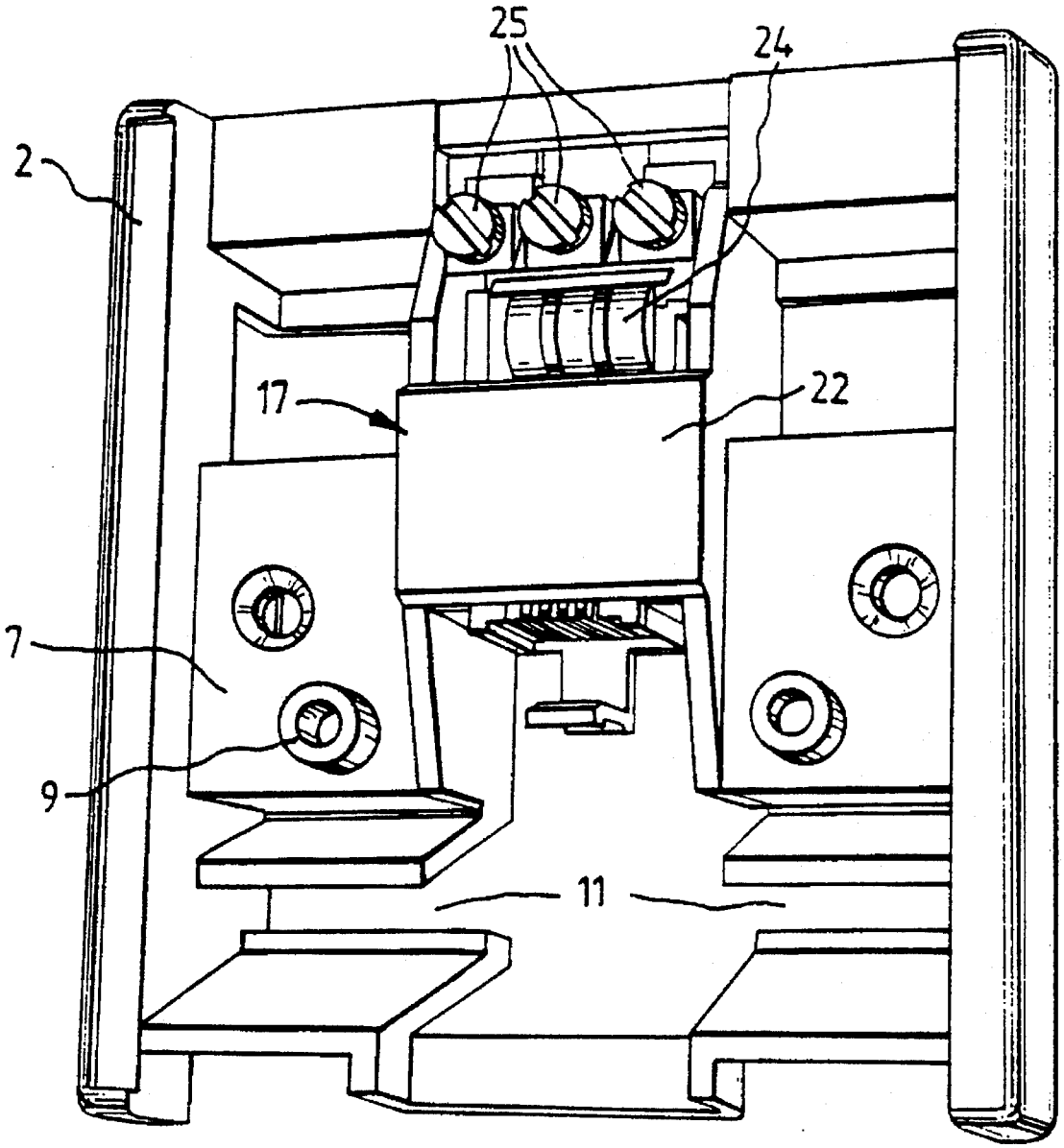
FIG. 6 is a perspective top view of the termination unit in the second embodiment with removed second access cover.

FIG. 6 shows another embodiment of the termination unit, wherein the connection elements 25 receiving the wiring are accessible from the front, after removing a second access cover 29 forming the upper portion of the front portion 2 (FIG. 1). Removal of the second access cover 29 makes the gas-discharge tube 24 accessible and permits therefore access by an engineer or technician without removing the complete front portion 2. This is advantageous, since the engineer has both hands free to perform his job.

Figure 9:
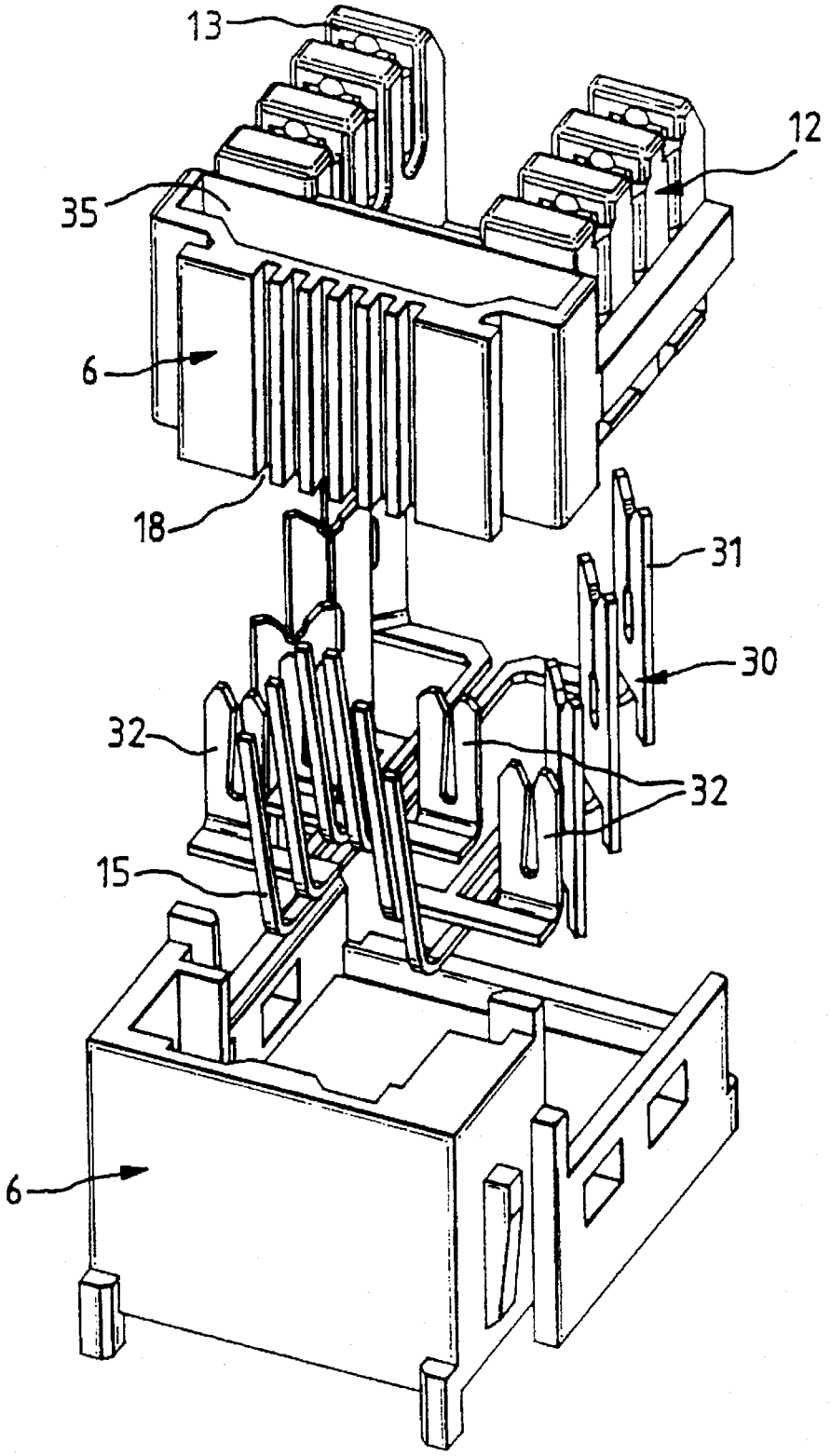
FIG. 9 is a perspective exploded view of an embodiment of the plug connector with plug socket and additional clamping contacts.
Figure 10:
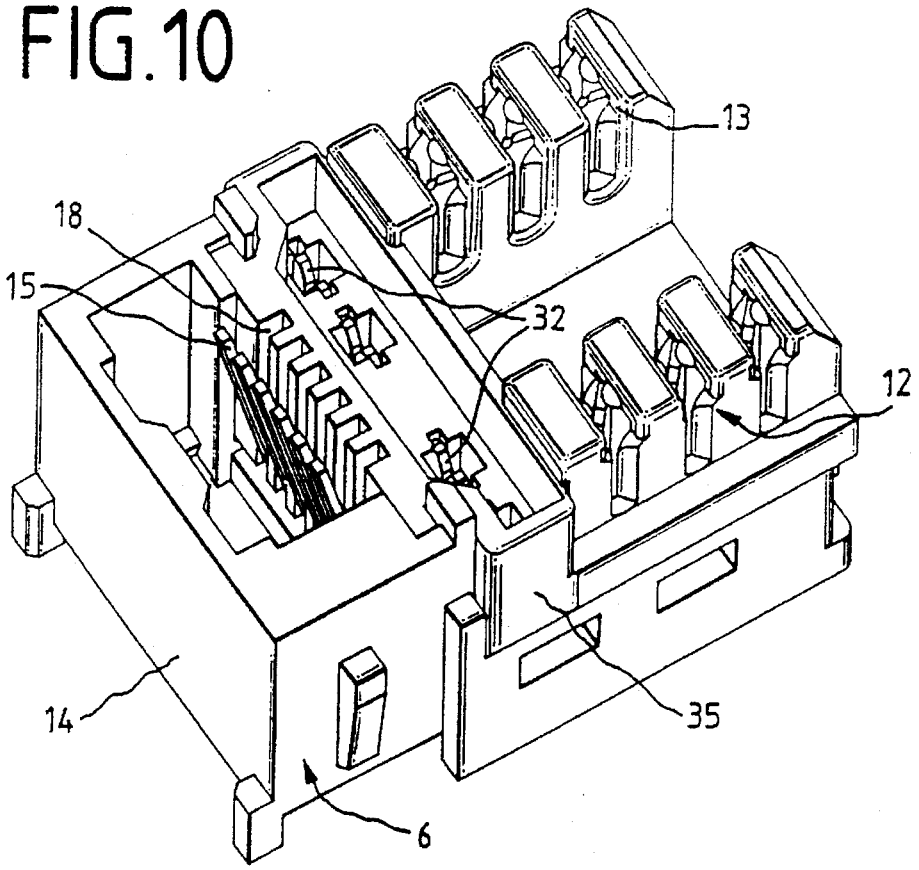
FIG. 10 is a perspective top view of the plug connector with plug socket of FIG. 9 in assembled condition.

In FIGS. 9 and 10, another embodiment of the plug connector 12 and of the plug socket 6 is shown.

The exploded view of FIG. 9 shows the plug connector 12 with a chamber 35, the insulation displacement contact elements 30, additional clamping contact elements 32 and the plug socket 6. Into the contact slots 13 of the plug connector 12 are respectively inserted the insulation displacement contacts 31 and into the contact slots 18 of the plug socket 6, the contacts 15 of the insulation displacement contact elements 30. Additional clamping contact elements 32 are arranged in the chamber 35 of the plug connector 12 such that an electrical connection between the plug connector 12 with the plug socket 6 and the component unit 17 can be established.

FIG. 10 shows the assembly of the individual elements of FIG. 9 and in particular the easy accessibility to the insulation displacement contact elements 32 in the chamber 35.

Figure 12:
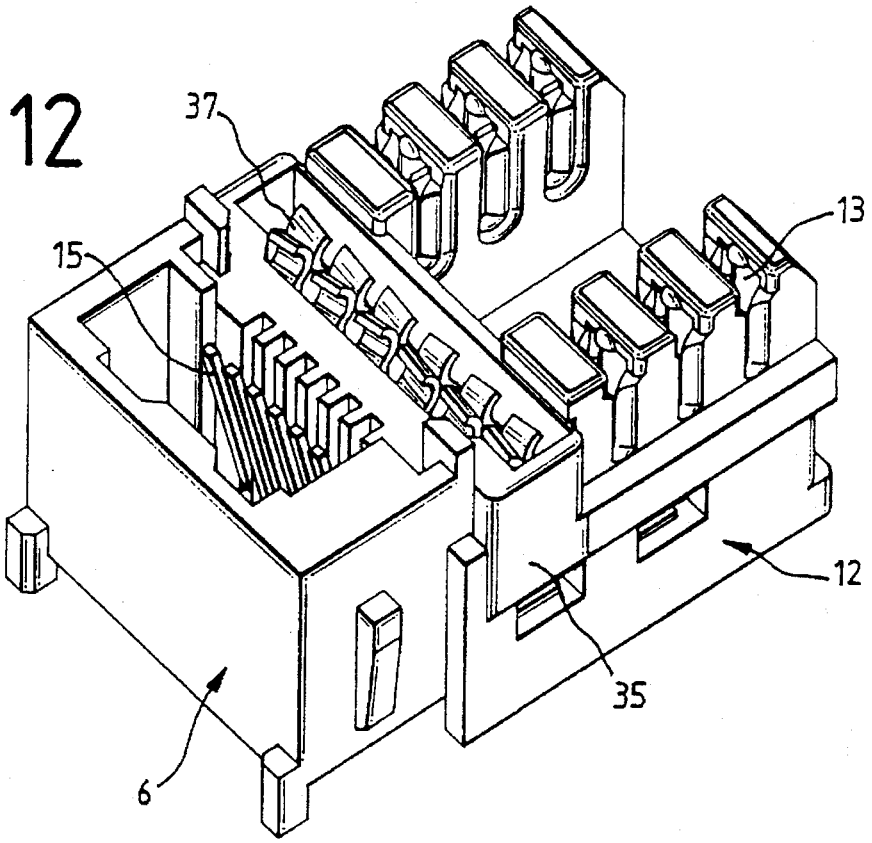
FIG. 12 is a perspective top view of the plug connector with plug socket of FIG. 11 in assembled condition.
Figure 11:
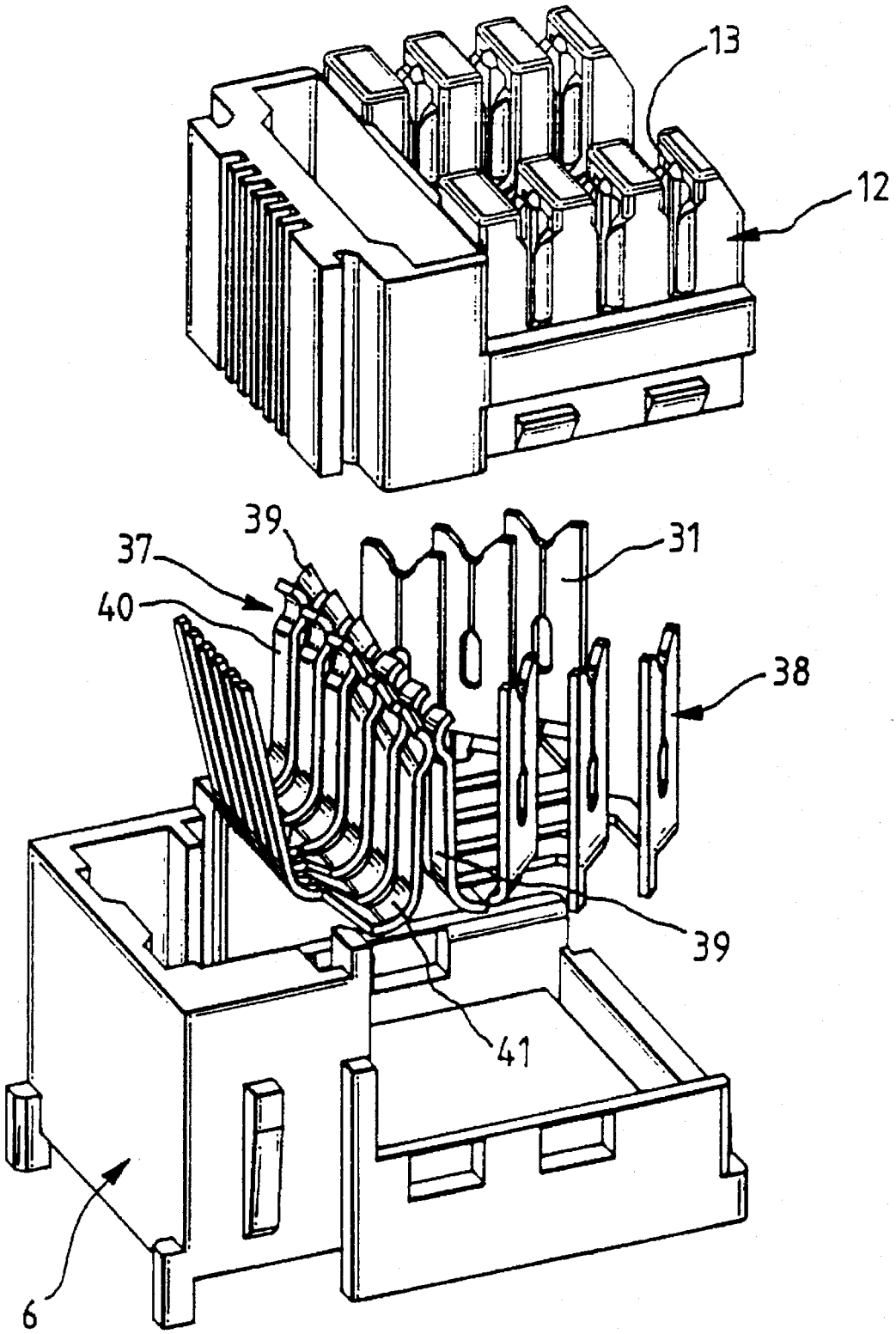
FIG. 11 is a perspective exploded view of an embodiment of the plug connector with plug socket and with disconnect contacts.

FIGS. 11 and 12 show an embodiment of the plug connector 12 with the plug socket 6 with additional disconnect contact elements 37 in the chamber 35.

The exploded view of FIG. 11 shows the plug connector 12 with the chamber 35, the insulation displacement contact elements 38, the disconnect contact elements 37 and the plug socket 6.

The insulation displacement contact elements 38 of the plug connector 12 are respectively inserted with their insulation displacement contacts 31 into the contact slots 13 and with the bent-off contact legs 39 into the chamber 35 in the area of the plug connector 12. The contact elements 40 are inserted with their contacts 15 into the plug socket 6 and form the disconnect contact elements 37, together with their bent-off contact legs 41 inserted into the chamber 35. The disconnect contact elements 37 can be used for measurement, test, separation, fault detection or the like.

From the assembled representation of FIG. 12 it is apparent that an easily accessible disconnect position is achieved by the disconnect contact elements 37 in the chamber 35. Not shown disconnect plugs, e.g., can be introduced into said disconnect position.

Figure 13:
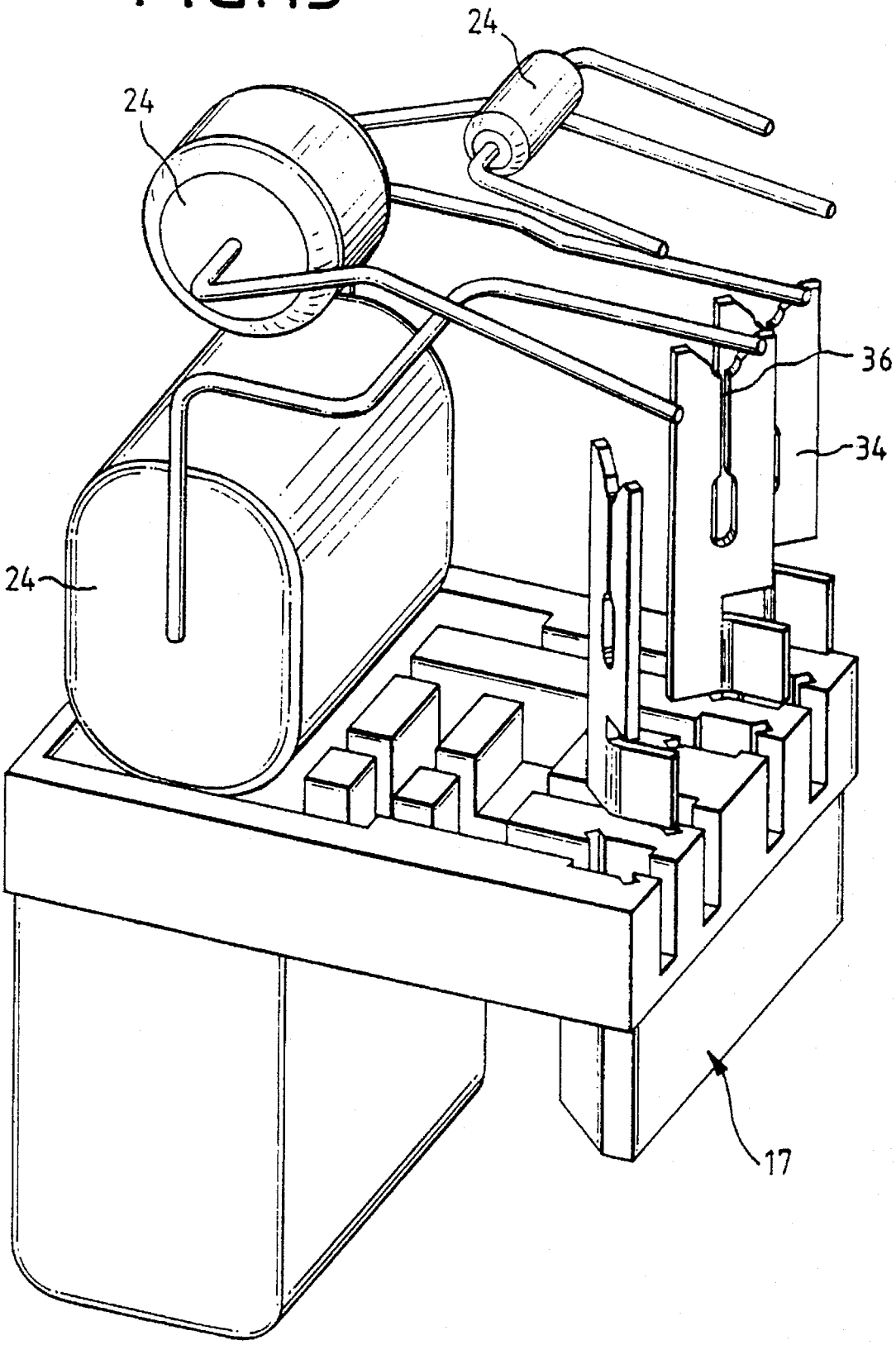
FIG. 13 is a perspective top view of another embodiment of the component unit.
Figure 14:
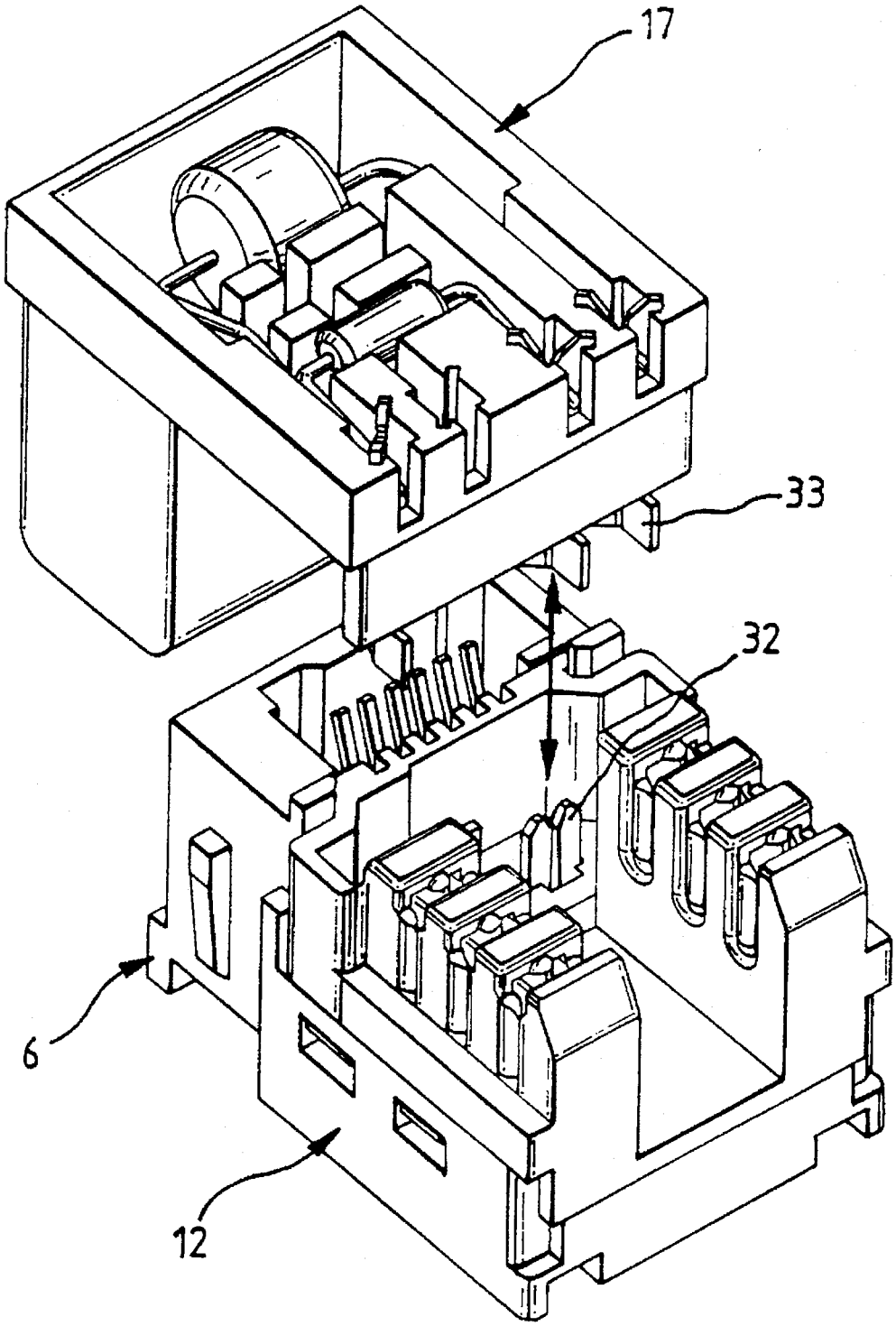
FIG. 14 is a perspective exploded view of a plug connection between the plug connector of FIGS. 9, 10 and the component unit of FIG. 13.

FIG. 13 shows an embodiment of the component unit 17, wherein the insulation displacement contact elements 34 are provided with contact tongues 33 (FIG. 14). The insulation displacement contacts 36 of the insulation displacement contact elements 34 serve for connection of components, such as fuse elements, surge arresters or the like, whereas the contact tongues 33 engage into the contact slots of the clamping contact elements 32 of the plug connector 12 and establish the electrical contact between the plug connector 12 with the plug socket 6, as is shown by way of example in FIG. 14.

FIG. 14 shows a connection of the units plug connector 12 with the plug socket 6 and the component unit 17 by the additional clamping contact elements 32. Instead of the clamping contact elements 32, however, disconnect contact elements 37 can also be inserted into the chamber 35.

Figure 15:
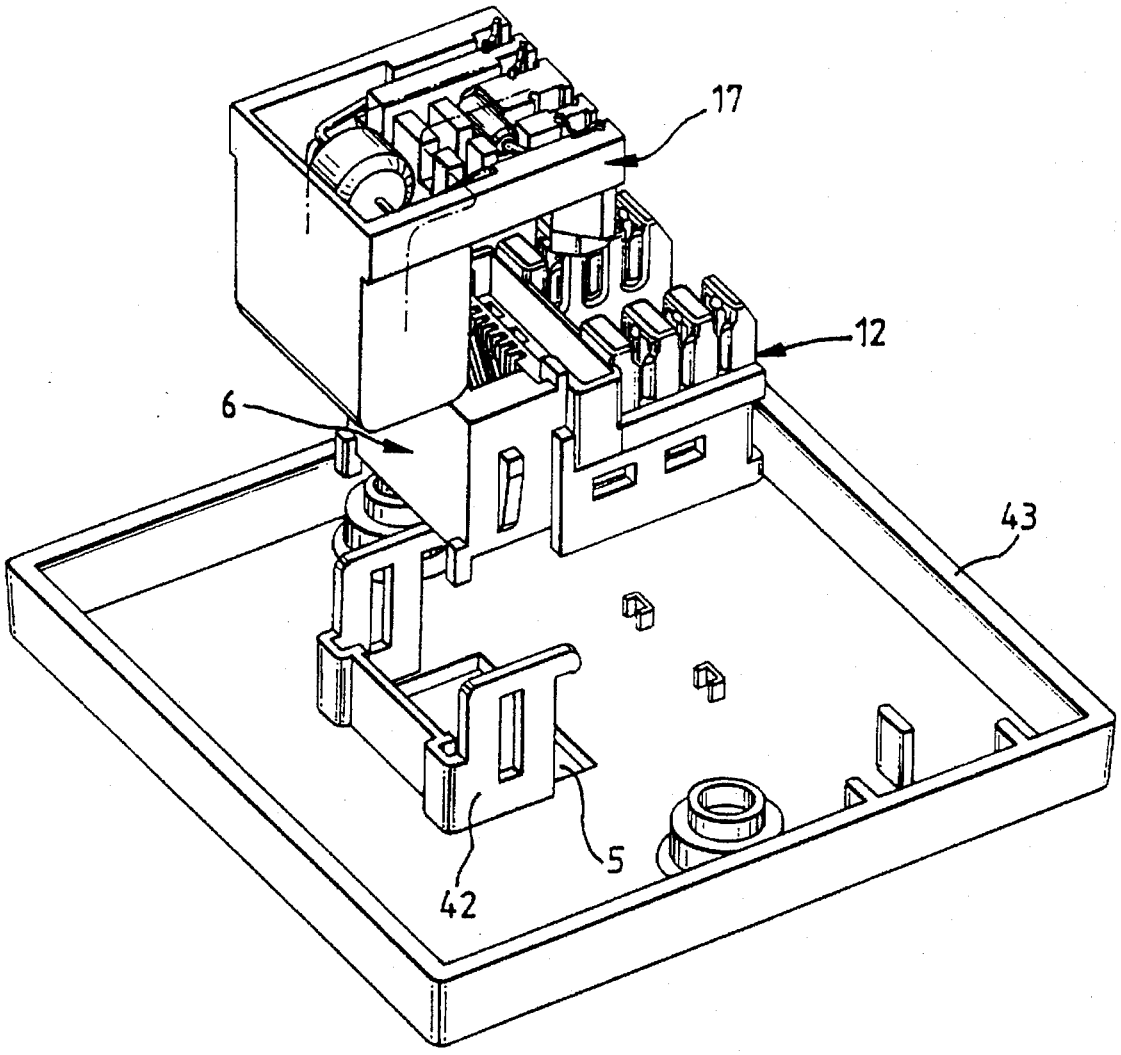
FIG. 15 is a perspective exploded view of a plug connection between a plug connector with a plug socket of FIG. 14 and a component unit in conjunction with a front portion.

FIG. 15 shows as an example the connection of the component unit 17 with the plug connector 12 and the plug socket 6 with a front portion 43 being connected as one piece to a frame. The front portion 43 comprises the insertion opening 5. Behind the insertion opening 5, the plug socket 6 can be latched in by means of various latch elements 42. By removing the front portion 43, all components are easily accessible and can readily be replaced in case of a fault.

Therefore the present invention provides a termination unit having a modular design, comprising an electrical plug connector 12 with a plug socket 6 and optionally a component unit 17 connected to the front portion 2 or 43 resp., by snap connections, for the assembly and replacement of the electrical plug connector 12 and of the component unit 17 an easy assembly and disassembly being possible. It is also possible to receive two or more plug connectors 12 with associated plug sockets 6 and component units 17 in the termination unit.

While specific embodiments of the invention have been shown and described in detail to illustrate the application of the principles of the invention, it will be understood that the invention may be embodied otherwise without departing from such principles.

What is claimed is:

1. A termination unit for telecommunication and data lines, comprising: a front portion; a frame, said front portion being provided formed as one piece together with said frame, said front portion being provided with a removable access cover, said removable access cover having an insertion opening; an electrical plug connector with contact elements for the lines; a plug socket connected to said plug connector, said electrical plug connector and said plug socket being disposed on a rear side of the removable access cover behind said insertion opening; and a component unit disposed on a rear side of said front portion, said component unit being connected to the plug connector and said plug socket.

2. A termination unit according to claim 1, wherein said plug connector is formed as one piece together with said contact elements and is disposed on the rear side of the access cover.

3. A termination unit according to claim 1, wherein said contact elements form part of insulation displacement contact elements, said plug connector being electrically connected to said plug socket by insulation displacement contacts of said insulation displacement contact elements, said insulation displacement contacts extending into said plug connector, and said contact elements of said insulation displacement contact elements extending into the plug socket; and additional contact elements including one of clamping contact elements and disconnect contact elements, provided in an area of said plug connector.

4. A termination unit according to claim 3, wherein said component unit has insulation displacement contact elements with contact tongues.

5. A termination unit according to claims 4, wherein said plug connector and said component unit are pluggably connected to each other by said contact tongues of said component unit and by said additional contact elements of said plug connector.

6. A termination unit according to claim 3, further comprising a disconnect plug inserted into said disconnect contact element.

7. A termination unit according to one of claim 1, wherein said frame comprises on a front side thereof, behind said removable access cover, a forwardly open receiving portion for insertion of said access cover, when said access cover is pivoted forwardly by approximately 120°.

8. A termination unit according to claim 1 wherein said front portion comprises another removable access cover, behind which said component unit, supported in said frame, is freely accessible.

9. An electrical termination unit comprising:

a frame;

a panel portion attached to said frame, said panel portion having first and second sides;

an access cover designed to be repetitively attachable to and detachable from said panel portion and said frame, said access cover having a first and second side, said access cover defining an insertion opening;

an electrical plug connector directly attached to said second side of said access cover, said electrical plug connector including a plug socket positioned adjacent said insertion opening, said plug socket including contact element means for connecting to electrical lines inserted though said insertion opening from said first side of said access cover;

a component unit directly attached to said second side of said panel portion, said component unit and said electrical plug connector having connection means for electrically connecting to and disconnecting from each other when said access cover is respectively connected to and disconnected from said panel portion.

10. A termination unit in accordance with claim 9, wherein:

said panel portion blocks access to all of said component unit but said connection means from said first side of said panel portion;

said access cover blocks access to said connection means from said first side of said panel portion when said access cover is connected to said panel portion in a closed position.

11. A termination unit in accordance with claim 9, wherein:

said first side of said panel portion and said access cover face externally from said frame.

12. A termination unit in accordance with claim 9, wherein:

said component unit includes electrical components.

13. A termination unit in accordance with claim 12, wherein:

said electrical components include a discharge tube.

* * * * *